US005992479A

United States Patent [19]

Simpson

[11] Patent Number: 5,992,479

[45] Date of Patent: Nov. 30, 1999

[54] DUAL FUNCTION PRESSURE/VACUUM SWITCH

[76] Inventor: W. Dwain Simpson, 124 Catalpa Rd., Wilton, Conn. 06897-2004

[21] Appl. No.: 09/137,550

[22] Filed: Aug. 20, 1998

[51] Int. Cl.[6] ..... B65B 1/30

[52] U.S. Cl. ..... 141/206; 141/209; 141/392; 141/225; 141/226

[58] Field of Search ..... 141/206, 209, 141/392, 217, 59, 219, 225, 226, 210, 301, 302, 382

[56] References Cited

U.S. PATENT DOCUMENTS 3,946,773 3/1976 Hansel ..... 141/206

4,913,200 4/1990 Carow ..... 141/217

5,184,309 2/1993 Simpson et al. .

5,307,848 5/1994 Murray ..... 141/206

*Primary Examiner*—Steven O. Douglas

*Assistant Examiner*—Khoa Huynh

*Attorney, Agent, or Firm*—Gottlieb, Rackman & Reisman, P.C.

[57] ABSTRACT

A fuel nozzle with both a Venturi shut-off mechanism and an electronic pressure switch shut-off mechanism. The increased reliability can be obtained at minimal increased cost if the two pressure-activated mechanisms are combined in a single housing so that each sensing port in effect becomes the reference pressure for the other.

7 Claims, 5 Drawing Sheets

DUAL FUNCTION PRESSURE/VACUUM SWITCH

This invention relates to fuel dispensing nozzles, and more particularly to improved shut-off mechanisms therefor.

BACKGROUND OF THE INVENTION

There are two different techniques presently in use for detecting the fluid level in the fill-pipe of a fuel tank to provide automatic shut-off of the dispensing of the fuel in order to prevent overflow from the fill-pipe. Both of the currently used techniques rely on the basic principle of using a diaphragm to sense a pressure difference. In both cases, the pressure on one side of the diaphragm is a reference pressure, and it is maintained at atmospheric pressure by a passageway or port that is open to air surrounding the nozzle. The diaphragm moves when the pressure at a sensing port or passageway in the nozzle spout is different from that of the reference, and movement of the diaphragm controls shut-off of the fuel flow.

The first technique that is used to control the shut-off of fuel (gasoline, diesel, etc.) flow from a dispensing nozzle spout that is inserted into the fill-pipe of a tank of a motor vehicle or other fuel container relies on a Venturi shut-off mechanism. The second, more recent, technique for controlling fuel shut-off uses an electronic pressure switch. Although one mechanism is mechanical and the other is at least in part electronic, both rely on the action of a diaphragm as it responds to a pressure difference. The major distinction between the two control devices is that one depends upon a decrease in pressure being generated on one side of the diaphragm relative to atmospheric pressure on the other side, while the other depends upon a positive pressure increase on one side of the diaphragm relative to the atmospheric pressure on the other side, as will be described in detail below. What they have in common is that the sensing port is in the nozzle spout, near the tip, and gets covered by fuel as the tank fills. It is the covering of the sensing port that provides a sudden difference in pressure (positive in one case, negative in the other) across the diaphragm.

With the introduction of newly developed vapor recovery systems, particularly vacuum assist systems, sudden changes in the pressure in the fill-pipe region near the sensing port have been observed. Such changes affect the reliability of operation of a shut-off mechanism. It has become important to provide a more reliable shut-off mechanism.

SUMMARY OF THE INVENTION

It is an object of the present invention to provide an improved shut-off mechanism.

This is achieved in the invention by combining both types of prior art mechanisms, at little increased cost, with fuel shut-off being effected if either mechanism operates. In one embodiment of the invention, a single diaphragm is used for both mechanisms, although two separate diaphragms may be used for greater reliability, at slightly increased cost.

If the fill rate is very fast, it is possible for there to be a splash-back before the fuel tank is full. It is desirable to shut off the fuel flow in such a case so that there are no leaks around the nozzle. The response of an electronic pressure switch is not as fast as that of a Venturi mechanism in case of a splash-back because the switch sensitivity of the former is not reached until liquid actually enters the sensing port or the fill-pipe pressure increases rapidly enough to trigger the switch. The Venturi switch, however, is powered by the flow of fuel, and it can respond rapidly to a simple covering of the port with a small amount of liquid. On the other hand, one of the advantages of an electronic pressure switch is that if the level of the fuel reaches the tip of the spout (or a fraction of an inch above it), the trigger mechanism becomes completely disabled, and filling can continue only by retracting the nozzle from the fill-pipe. It is not possible to cause more fuel to flow by repeatedly operating and releasing the trigger. Using both switch mechanisms together offers the advantages of each.

Another advantage is that while accidental covering of the pressure port will disable an electronic pressure switch, the Venturi mechanism in such a case will still generate sufficient vacuum to trigger shut-off. Similarly, if the Venturi vacuum generator gets clogged and the Venturi switch can no longer function, the pressure switch still remains operative. Using both mechanisms also results in less adjustment being required for different fuel viscosities since the pressure switch would be used mostly for preventing pumping of the trigger, with the Venturi switch, which is less dependent on the viscosity of the fuel, operating as the primary shut-off mechanism.

DETAILED DESCRIPTION

Further objects, features and advantages of the invention will become apparent upon consideration of the following detailed description in conjunction with the drawing, in which.

Figure 1:
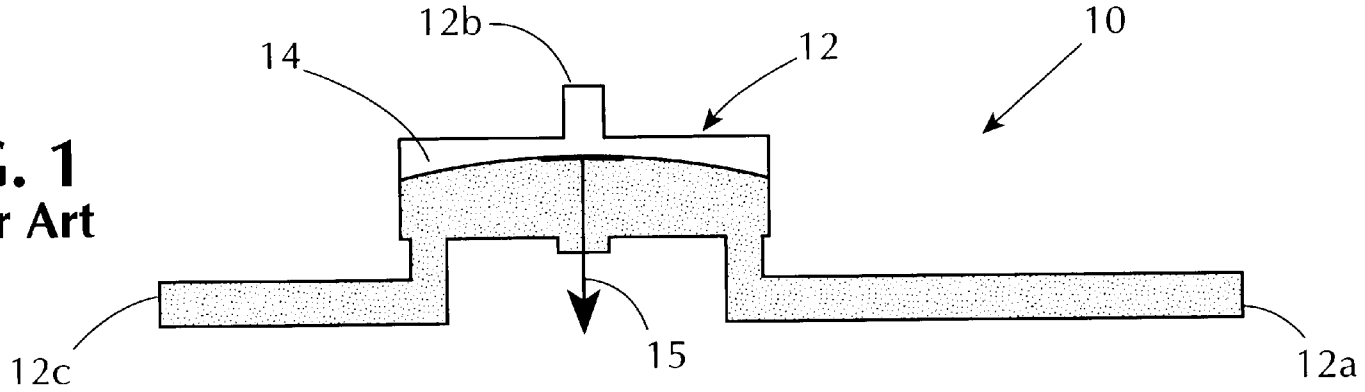
FIG. 1 Prior Art
FIG. 1 is a symbolic representation of a prior art Venturi shut-off mechanism.

The standard Venturi shut-off mechanism 10 of FIG. 1 includes a pressure-activated diaphragm 14 (whose curvature is shown exaggerated) that is fixed within a housing 12. On one side of the diaphragm reference port 12*b* is open to atmospheric pressure. On the other side of the diaphragm the housing communicates with a Venturi port 12*a* that is typically positioned at the tip of the nozzle spout. It is this sensing port 12*a* that gets covered by fuel as the tank fills. Housing 12 also includes a passageway with an open end 12*c* that is coupled to a known vacuum source (not shown in the drawings). The vacuum source simply causes air to flow from port 12*a* through the housing and out of port 12*c* to the vacuum source. The pressure difference across diaphragm 14 is minimal because the Venturi port is open to the atmosphere within the fill-pipe, as port 12*b* is open to the atmosphere, and the airflow in the housing gives rise to a minimal pressure difference across the diaphragm.

However, as soon as the fuel level in the tank rises to the point that the spout Venturi port is covered, the vacuum source at port 12*c* greatly lowers the pressure within the housing underneath the diaphragm. The diaphragm now flexes since the pressure on the side exposed to the atmosphere is so much greater. A mechanical coupling, shown symbolically by arrow 15, disables the trigger mechanism in the nozzle, and the fuel-flow valve in the nozzle closes. (The shut-off coupling is shown only symbolically by arrow 15. There are literally dozens of different pressure-activated mechanisms in use.)

Figure 2:
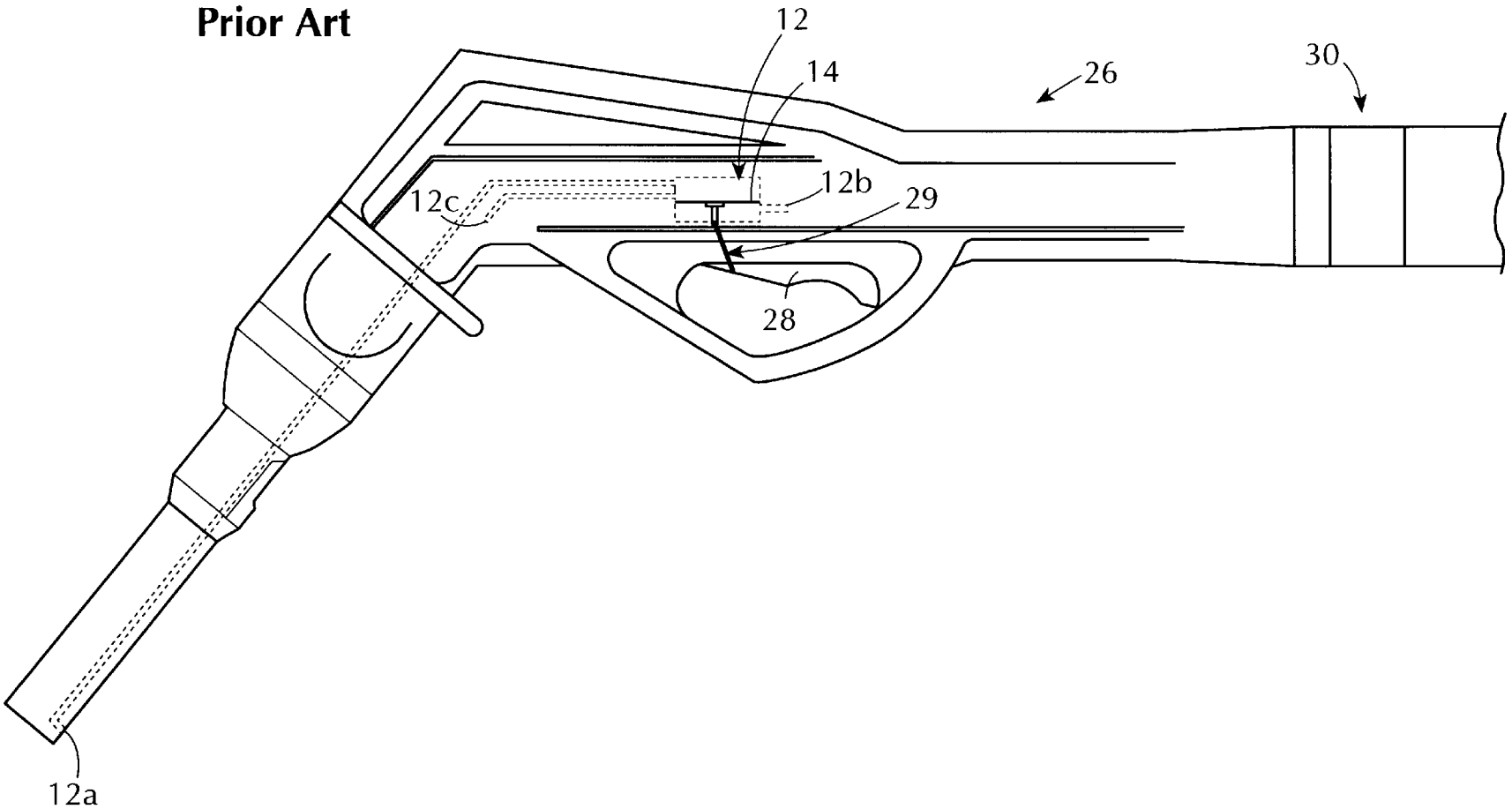
FIG. 2 Prior Art
FIG. 2 depicts a prior art nozzle with a Venturi shut-off mechanism.

The arrangement of a Venturi shut-off mechanism in a prior art nozzle 26 is depicted in FIG. 2. (The nozzle is connected by coupling 30 to a fuel hose, either a standard hose or one that facilitates vapor recovery.) Housing 12 is shown slightly above trigger 28 of the nozzle. The Venturi port 12*a* is shown at the tip of the nozzle spout. While the nozzle spout is in the fuel fill-pipe (not shown), the pressure within the fill-pipe is atmospheric. Air is sucked into port 12*a* and flows into housing 12. The air exits the housing through port 12*c* that is connected to the vacuum source. Referring back to FIG. 1, the third housing port 12*b* is open to the atmosphere. When sensing port 12*a* is covered by fuel, the diaphragm within housing 12 flexes and the mechanical coupling to the trigger 28, shown symbolically by numeral 29, causes the trigger to deactivate and fuel flow to cease.

Figure 3:
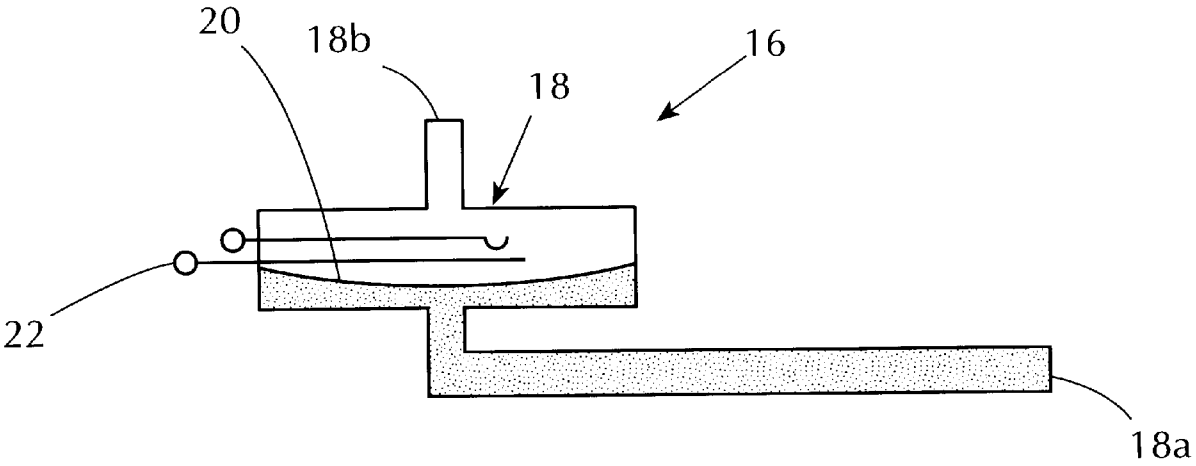
FIG. 3 Prior Art
FIG. 3 is a symbolic representation of a prior art electronic pressure switch shut-off mechanism.

With an electronic pressure switch, as shown symbolically by numeral 16 in FIG. 3, there is no need for a port of the housing to be connected to a vacuum generator. There are only two ports on housing 18, spout sensing port 18*a* which serves the same function as spout sensing port 12*a* in the Venturi shut-off mechanism, and port 18*b* which serves the same function as port 12*b* in the Venturi shut-off mechanism. As long as port 18*a* is open to the atmosphere, there is no pressure difference across diaphragm 20, and the contacts 22 of an electronic switch (not shown) remain open. As the fuel rises and covers port 18*a*, the air in housing 18 on the high-pressure side of the diaphragm is compressed and the diaphragm moves to close switch contacts 22. The diaphragm flexes because port 18*b* is still open to the atmosphere, and the pressure on the other side of the diaphragm is now greater than atmospheric. (Instead of providing normally-open contacts, it is possible to use normally closed contacts. In either case, a change in the state of the contacts operates an electronic circuit that causes fuel flow to stop.)

Figure 4:
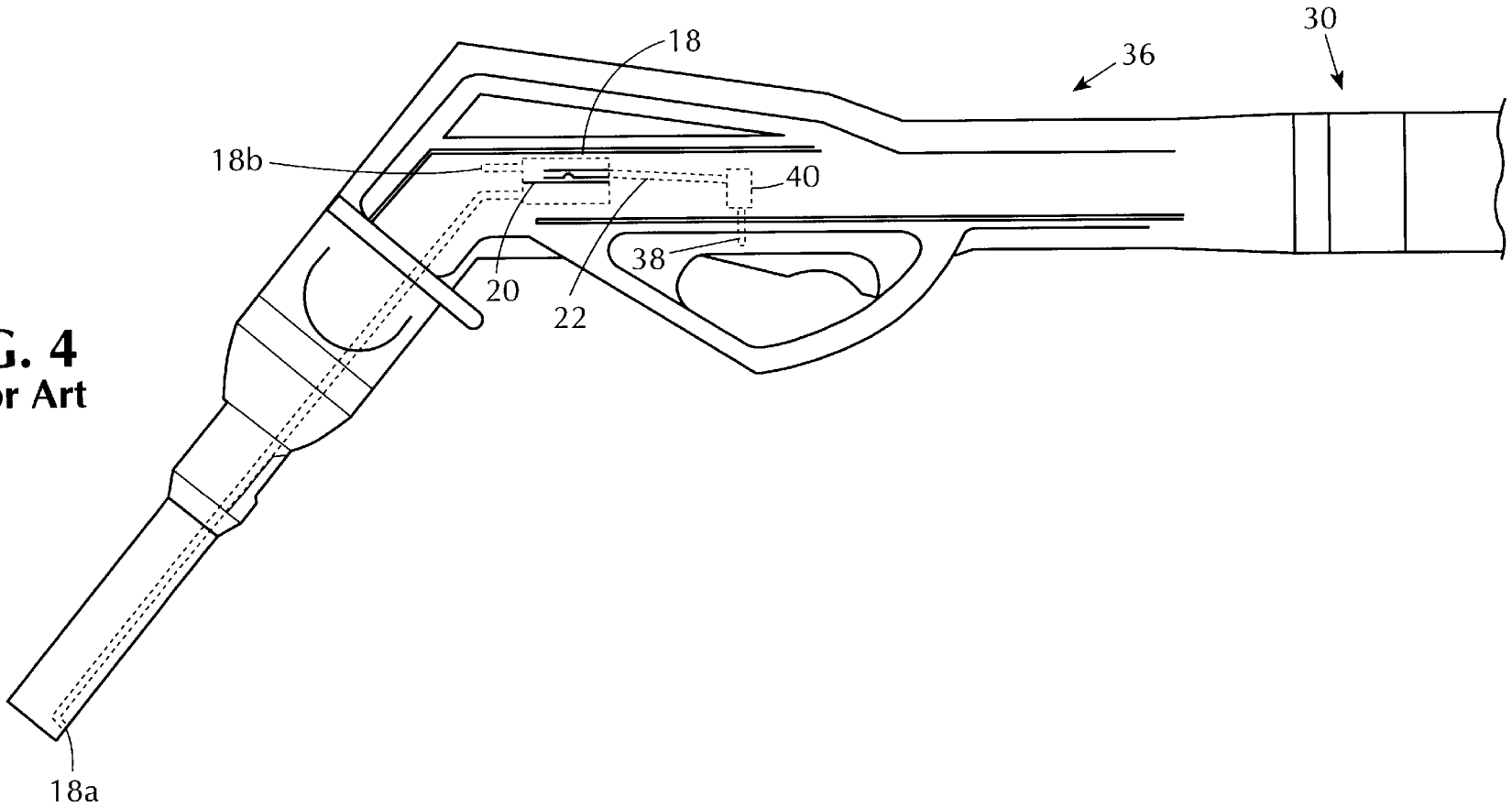
FIG. 4 Prior Art
FIG. 4 depicts a prior art nozzle with an electronic pressure switch shut-off mechanism.

FIG. 4 shows an electronic pressure switch in a typical present-day (prior art) nozzle. The nozzle mechanism 36 is connected once again by a coupling 30 to a fuel hose (standard or vapor recovery). The housing 18 of the switch has two ports, 18*b* which is open to the atmosphere and 18*a* which is the sensing port at the tip of the nozzle spout. The drawing shows an electronic switch 40 which may be a solenoid or other device which, via a mechanical connection, shown only symbolically by the numeral 38, deactivates the trigger mechanism when the fuel rises to cover port 18*a*.

Figure 5:
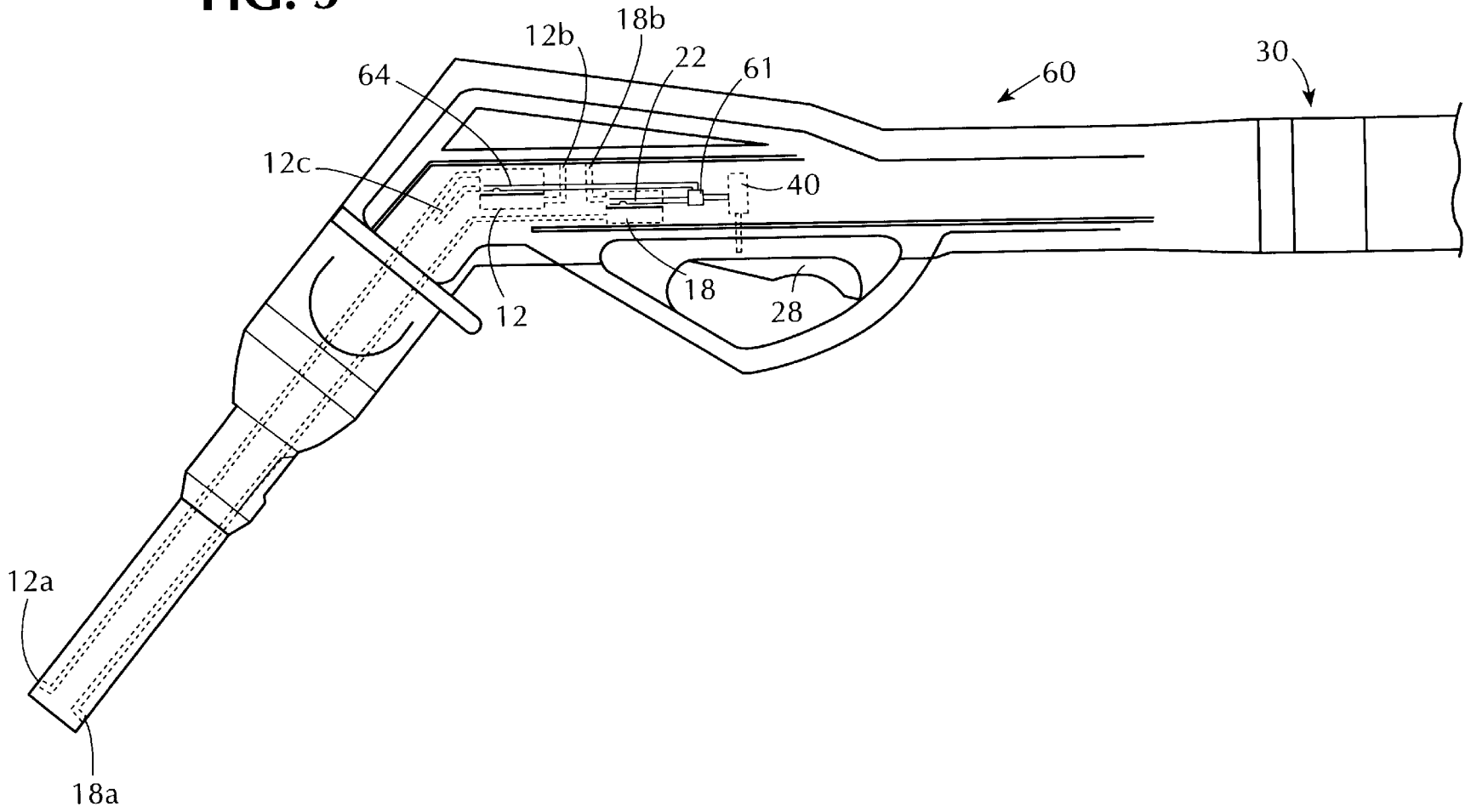
FIG. 5 depicts a first embodiment of my invention, a nozzle which uses separate Venturi and electronic pressure switch shut-off mechanisms.

The first embodiment of the invention is shown in FIG. 5. Simply stated, the nozzle 60 includes both types of switch mechanisms. Although in FIGS. 1 and 2 the diaphragm has been described as being connected to a mechanical actuating element, and in FIGS. 3 and 4 the diaphragm has been described as changing the state of a set of contacts, in order that either switch operate the same shut-off valve or other comparable mechanism, it is convenient (but not necessary) to provide the same kind of actuator on both diaphragms. For this reason, in the illustrative embodiments of the invention, even the Venturi mechanism is equipped to change the state of a pair of contacts. Thus, in FIG. 5 it will be seen that not only does housing 18 (which contains the electronic pressure switch) control the state of a pair of contacts 22, but so does housing 12 (which contains the Venturi switch mechanism), these contacts being shown by the numeral 64. Contacts 64 as well as contacts 22 are extended to a logic circuit 61 which can be nothing more than a conventional OR gate. When either pair of contacts closes, solenoid 40 (or a comparable actuator) operates to release trigger 28 and cause fuel flow to stop.

Referring back to FIG. 2, it will be seen that the shut-off mechanism of that drawing is included in nozzle 60 of FIG. 5 in the same general configuration. Sensing port 12*a* is at the tip of the spout nozzle and is extended to housing 12. Port 12*c* is connected to a Venturi generator, with ports 12*a* and 12*c* being on the same side of the diaphragm within the housing. Port 12*b* is open to the atmosphere on the high-pressure side of the diaphragm. When port 12*a* gets covered by fuel, contacts 64 close and actuator 40 releases trigger 28.

Similarly, the electronic pressure switch mechanism of FIG. 4 is incorporated in nozzle 60 of FIG. 5 in the same configuration as it is shown in the former drawing. Housing 22 has only two ports, port 18*a* being in the spout nozzle, and port 18*b* being open to the atmosphere. The two different switch mechanisms operate as they did in the prior art, the significant difference being that if either detects the rise of the fuel level to its respective sensing port in the spout nozzle, then the trigger is released so that fuel flow will stop. In addition to the obvious advantage of fail-safe operation, as discussed above, each switch offers its own set of advantages.

Figure 6:
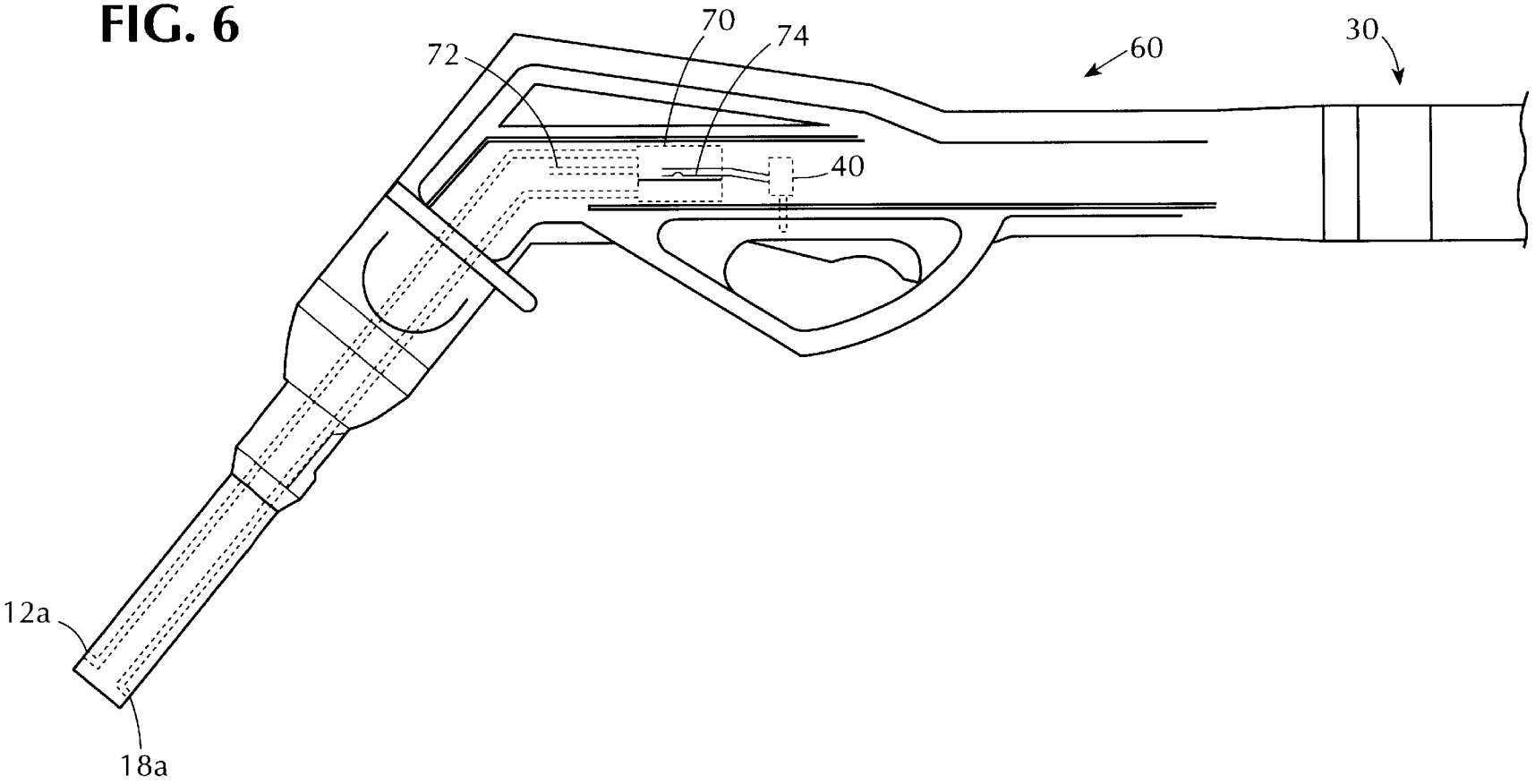
FIG. 6 depicts a second embodiment of my invention, a nozzle which uses both shut-off mechanisms but with only a single diaphragm.

FIG. 6 shows the second embodiment of the invention. The main difference between the nozzles of FIG. 5 and FIG. 6 is that in the latter there is only one switch housing 70, a single diaphragm and a single set of contacts 74.

The housing has three ports. Port 72 is connected to a vacuum source and is comparable to port 12*b* in FIG. 5. Thus, when sensing port 12*a* is covered by fuel, the vacuum created as a result of the air being drawn out of port 72 causes a pressure decrease on that side of the diaphragm containing these two ports. Port 18*a* is connected to the housing on the other side of the diaphragm, and the increase at this port with a rising fuel level causes a positive increase in pressure on the respective side of the diaphragm. Both pressure changes cause the diaphragm to flex in the same direction (up in the drawing), so the effects are additive, although either mechanism by itself is sufficient to close the contacts and operate actuator 40 so that fuel flow ceases. In a sense, each chamber in housing 70, one on each side of the diaphragm, serves as the pressure reference for the other since in one case it is a pressure decrease that causes fuel flow to stop, and in the other it is a pressure increase. The two sensing mechanisms are complementary, and it is this feature that allows the use of only a single diaphragm.

In my co-pending application entitled "EQUALIZING FUEL NOZZLE SHUT-OFF MECHANISM", Ser. No. 09/137,911 filed on even date herewith, I disclose a technique for extending the reference port of a switch mechanism to the spout nozzle so that the sensing port and the reference port both communicate with the same volume of air surrounding the nozzle spout. There is no reference port in the embodiment of FIG. 6 since the chamber of the housing connected to each of the sensing ports in effect serves as the reference port for the other. But the embodiment of FIG. 5 has two reference pressure ports 12*b* and 18*b*, and they can be extended to the spout nozzle as disclosed in my co-pending application which is hereby incorporated by reference.

Although the invention has been described with reference to particular embodiments, it is to be understood that these embodiments are merely illustrative of the application of the principles of the invention. For example, the exact placement of the ports in the nozzle spout is not critical (although the closer to the tip of the nozzle spout, the better). Thus, it is to be understood that numerous modifications may be made in the illustrative embodiments of the invention and other arrangements may be devised without departing from the spirit and scope of the invention.

What I claim is:

1. A fuel nozzle comprising a nozzle spout for delivering fuel from an opening at the end thereof; a first pressure-activated mechanism for indicating that fuel in a tank being filled has risen to a predetermined level; a second pressure-activated mechanism for indicating that fuel in a tank being filled has risen to a predetermined level; and a mechanism for controlling shut-off of fuel flow responsive to either of said first or second pressure-activated mechanisms indicating that fuel in said tank has risen to a predetermined level; each of said first and second pressure-activated mechanisms having a respective first or second sensing port at the tip of said nozzle spout; said first pressure-activated mechanism operating to indicate that fuel in said tank has risen to a predetermined level in response to a sufficient decrease in pressure at said first sensing port, and said second pressure-activated mechanism operating to indicate that fuel in said tank has risen to a predetermined level in response to a sufficient increase in pressure at said second sensing port; said nozzle being configured to be inserted into said fill-pipe of a fuel tank such that said first and second sensing ports both communicate with the same volume of air surrounding said nozzle spout within said fill-pipe, with a rising fuel level in said tank covering both of said first and second sensing ports.

2. A fuel nozzle in accordance with claim 1 wherein said first pressure-activated mechanism is a Venturi shut-off device that includes a source of reference pressure and operates to indicate that fuel in said tank being filled has risen to a predetermined level in response to the difference between the pressure at said first sensing port and said source of reference pressure being negative.

3. A fuel nozzle in accordance with claim 1 wherein said second pressure-activated mechanism is an electronic shut-off device that includes a source of reference pressure and operates to indicate that fuel in said tank being filled has risen to a predetermined level in response to the difference between the pressure at said second sensing port and said source of reference pressure being positive.

4. A fuel nozzle in accordance with claim 1 wherein said first pressure-activated mechanism is a Venturi shut-off device that includes a first source of reference pressure and operates to indicate that fuel in said tank being filled has risen to a predetermined level in response to the difference between the pressure at said first sensing port and said first source of reference pressure being negative; and said second pressure-activated mechanism is an electronic shut-off device that includes a second source of reference pressure and operates to indicate that fuel in said tank being filled has risen to a predetermined level in response to the difference between the pressure at said second sensing port and said second source of reference pressure being positive.

5. A fuel nozzle in accordance with claim 4 wherein the pressure in said second sensing port serves as said first source of reference pressure and the pressure in said first sensing port serves as said second source of reference pressure.

6. A fuel nozzle in accordance with claim 5 wherein said first and second pressure-activated mechanisms are housed together and include a common diaphragm which, when flexed, indicates that fuel in a tank being filled has risen to a predetermined level; each of said first and second sensing ports being coupled to a chamber of said housing on a different side of said diaphragm.

7. A fuel nozzle in accordance with claim 6 further including a Venturi vacuum source connected to the housing chamber to which said first sensing port is coupled.

* * * * *